US006300914B1

(12) United States Patent
Yang

(10) Patent No.: US 6,300,914 B1
(45) Date of Patent: Oct. 9, 2001

(54) FRACTAL LOOP ANTENNA

(75) Inventor: Xianhua Yang, Arlington, VA (US)

(73) Assignee: APTI, Inc.

( * ) Notice: Subject to any disclaimer, the term of this patent is extended or adjusted under 35 U.S.C. 154(b) by 0 days.

(21) Appl. No.: 09/373,455

(22) Filed: Aug. 12, 1999

(51) Int. Cl.[7] ..... H01Q 11/12
(52) U.S. Cl. ..... 343/741; 343/702; 343/895
(58) Field of Search ..... 343/741, 866, 343/895, 870, 803, 792.5, 700 R, 718, 728, 702

(56) References Cited

U.S. PATENT DOCUMENTS

| | | | | |
|---|---|---|---|---|
| 3,534,372 | * | 10/1970 | Scheurecker et al. | 343/792.5 |
| 4,595,930 | * | 6/1986 | Fisher, Jr. | 343/792.5 |
| 5,006,858 | * | 4/1991 | Shirosaka | 343/700 R |
| 5,929,825 | * | 7/1999 | Niu et al. | 343/866 |
| 6,043,792 | * | 3/2000 | Finlayson | 343/866 |
| 6,104,349 | * | 8/2000 | Cohen | 343/702 |
| 6,140,975 | * | 10/2000 | Cohen | 343/846 |
| 6,166,694 | * | 12/2000 | Ying | 343/702 |

FOREIGN PATENT DOCUMENTS

WO9925044 5/1999 (WO) ..... H01Q/1/38

OTHER PUBLICATIONS

D. Werner et al., "Fractal Constructions of Linear and Planar Arrays", 3/97, pp. 1968–1971, 1997 IEEE.
D. Jaggard et al., "Cantor Ring Arrays", 2/98, pp. 866–869, 1998 IEEE.
C. Puente et al., "Variations on the Fractal Sierpinski Antenna Flare Angle", 2/98, pp. 2340–2343, 1998 IEEE.
Nathan Cohen, "Fractal Antenna Applications in Wireless Telecommunications", 8/97, pp. 43–49, 1997 IEEE.
Manfred Schroeder, "Fractals, Chaos, Power Laws", pp. 7–13, W.H. Freeman & Co.
X. Yang et al., "Fractal Antenna Elements and Arrays", 5/99, pp. 34–46, Applied Microwave & Wireless, vol. 11 No. 5.

* cited by examiner

*Primary Examiner*—Don Wong
*Assistant Examiner*—Thuy Vinh Tran
(74) *Attorney, Agent, or Firm*—Rossi & Associates

(57) ABSTRACT

A reduced size wideband antenna operates at multiple frequency bands. The antenna is formed from a plurality of fractal elements either cascade connected, series connected or parallel connected. The fractal elements of the antenna structure repeat a specific geometric shape.

7 Claims, 10 Drawing Sheets

FRACTAL LOOP ANTENNA

FIELD OF THE INVENTION

This invention relates in general to reduced size broadband antennas for wireless communication systems and other wireless applications. More specifically, the invention relates to a fractal loop antenna that includes a plurality of fractal elements. The fractal elements are connected either in cascade, series or parallel.

BACKGROUND OF THE INVENTION

Wideband antennas for wireless low frequency band reception are well known in the art. With the advance of new generation of wireless communication systems and the increasing importance of other wireless applications, low profile wideband antennas are in great demand in both commercial and military applications. Multi-band and wideband antennas are desirable for personal communication systems, small satellite communication terminals, and other wireless applications. Wideband antennas also find applications in Unmanned Aerial Vehicles (UAVs) when they are embedded into the airframe structure, in Counter Camouflage, Concealment and Deception (CC&D), Synthetic Aperture Radar (SAR), and Ground Moving Target Indicators (GMTI).

Traditionally, wideband antennas in wireless low frequency band can only be achieved with heavily loaded wire antennas, which means that a different antenna is needed for each frequency band. As a result, these antennas are large in size and they are cumbersome and bulky for personal mobile use. It would therefore be desirable to provide an antenna structure that overcomes the deficiencies of conventional antenna structures.

SUMMARY OF THE INVENTION

The present invention provides a reduced size wideband antenna, in which a single compact antenna structure operates at multiple frequency bands. The antenna is composed of a plurality of fractal elements, each of which repeats a specific geometric shape. The fractal elements can be formed in the same plane or formed in multiple planes to provide a three dimensional antenna structure.

BRIEF DESCRIPTION OF THE DRAWINGS

The invention will now be described with reference to certain preferred embodiments thereof and the accompanying drawings, wherein.

DETAILED DESCRIPTION OF THE PREFERRED EMBODIMENTS

Benoit B. Mandelbrot investigated the relationship between fractals and nature using the discoveries made by Gaston Julia, Pierre Fatou and Felix Hausdorff, see B. B. Mandelbrot, *The Fractal Geometry of Nature.* San Francisco, Calif.: Freeman, 1983, and showed that many fractals existed in nature and that fractals could accurately model some phenomenon. Mandelbrot introduced new types of fractals to model more complex structures like trees or mountains. By furthering the idea of a fractional dimension, Mandelbrot coined the term fractal, and his work inspired interest and has made fractals a very popular field of study.

Mandelbrot defined a fractal as a rough or fragmented geometric shape that can be subdivided in parts, each of which is approximately a reduced-size copy of the whole. A more strict mathematical definition is that a fractal is an object whose Hausdorff-Besicovitch dimension strictly exceeds its topological dimension.

Most fractal objects have self-similar shapes although there are some fractal objects that are hardly self-similar at all. Most fractals also have infinite complexity and detail, thus the complexity and detail of the fractals remain no matter how far an observer zooms-in on the object. Also, the dimensions of most fractal elements are a fraction of dimensions of the whole object.

In the present invention, the concepts of fractals is applied in designing antenna elements and arrays. Most fractals have infinite complexity and detail, thus it is possible to use fractal structure to design small size, low profile, and low weight antennas. Most fractals have self-similarity, so fractal antenna elements or arrays also can achieve multiple frequency bands due to the self-similarity between different parts of the antenna. Application of the fractional dimension of fractal structure optimizes the gain of wire antennas. The combination of the infinite complexity and detail plus the self-similarity which are inherent to fractal geometry, makes it possible to construct smaller antennas with very wideband performance. A fractal loop antenna is about 5 to 10 times smaller than an equivalent conventional wideband low frequency antenna.

Figure 1:
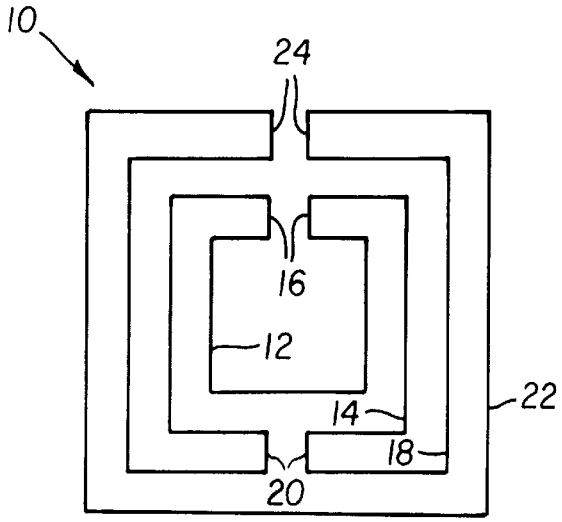
FIG. 1 illustrates a cascade connecting multiple fractal loop antenna in accordance with the present invention.

Referring now to FIG. 1, a cascade connected multiple fractal loop antenna 10 in accordance with the invention is illustrated that includes a first substantially square shaped fractal element 12 that is coupled to a second substantially square shaped fractal element 14 via connection paths 16. The second substantially square shaped fractal element 14 is also connected to a third substantially square shaped fractal element 18 via connection paths 20. The pattern of interconnected fractal element continues with the third substantially square shaped fractal element 18 being connected to a fourth substantially square shaped fractal element 22 via connection paths 24. The pattern can be repeated indefinitely based on the number of loops desired to provide multi-band or ultra-wideband operation.

Figure 2:
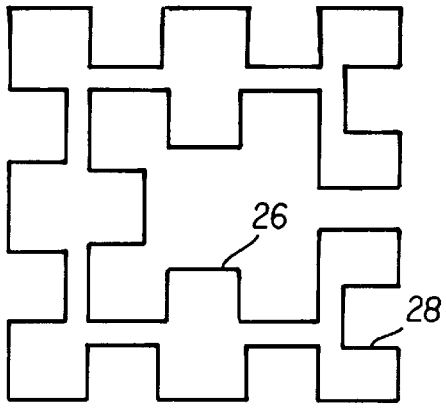
FIG. 2 illustrates a fractal loop antenna in accordance with the invention with folded side elements.
Figure 3:
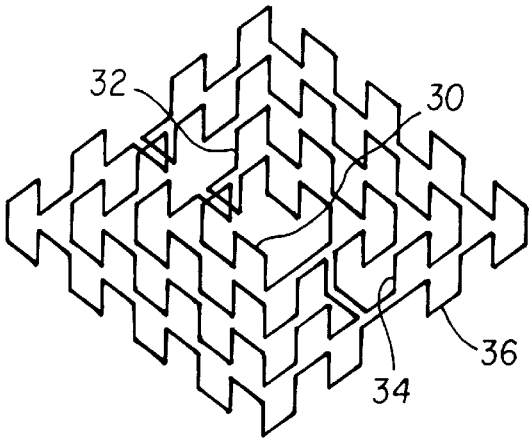
FIG. 3 illustrates a fractal loop antenna in accordance with the invention with elements folded to provide a three dimensional antenna structure.

In addition, modifications of the basic embodiment illustrated in FIG. 1 are possible. In FIG. 2, the sides of two square fractal elements 26, 28 are folded in the same plane as the fractal elements 26, 28 to form a sawtooth pattern. In FIG. 3, the sides of four fractal elements 30, 32, 34, 36 are folded in a plane perpendicular to the plane of the four fractal elements 30, 32, 34, 36, to form a three dimensional sawtooth pattern. Combinations of the illustrated variations are also possible.

Figure 4:
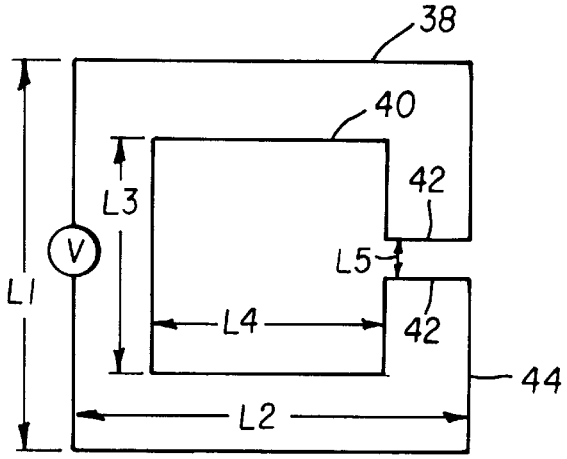
FIG. 4 illustrates a simple two fractal element antenna in accordance with the invention.
Figure 5A:
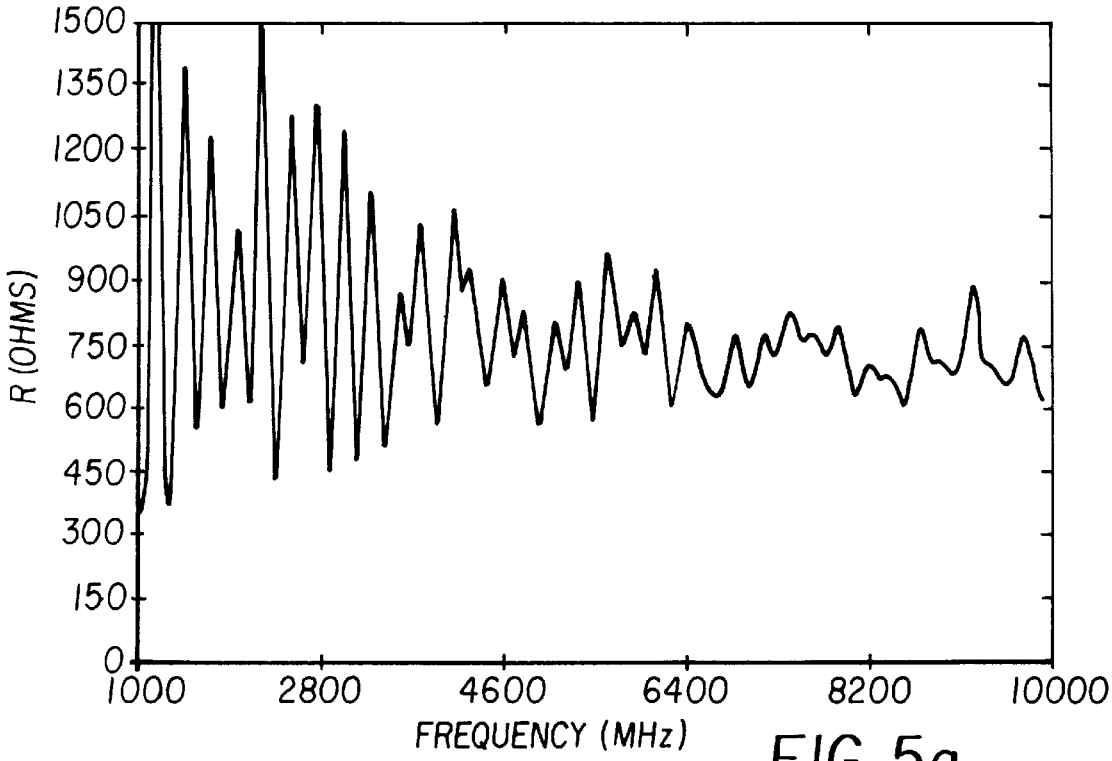
FIGS. 5(*a*) and (*b*) illustrate the input impedance of the antenna illustrated in FIG. 4 over a desired frequency bandwidth.
Figure 5B:
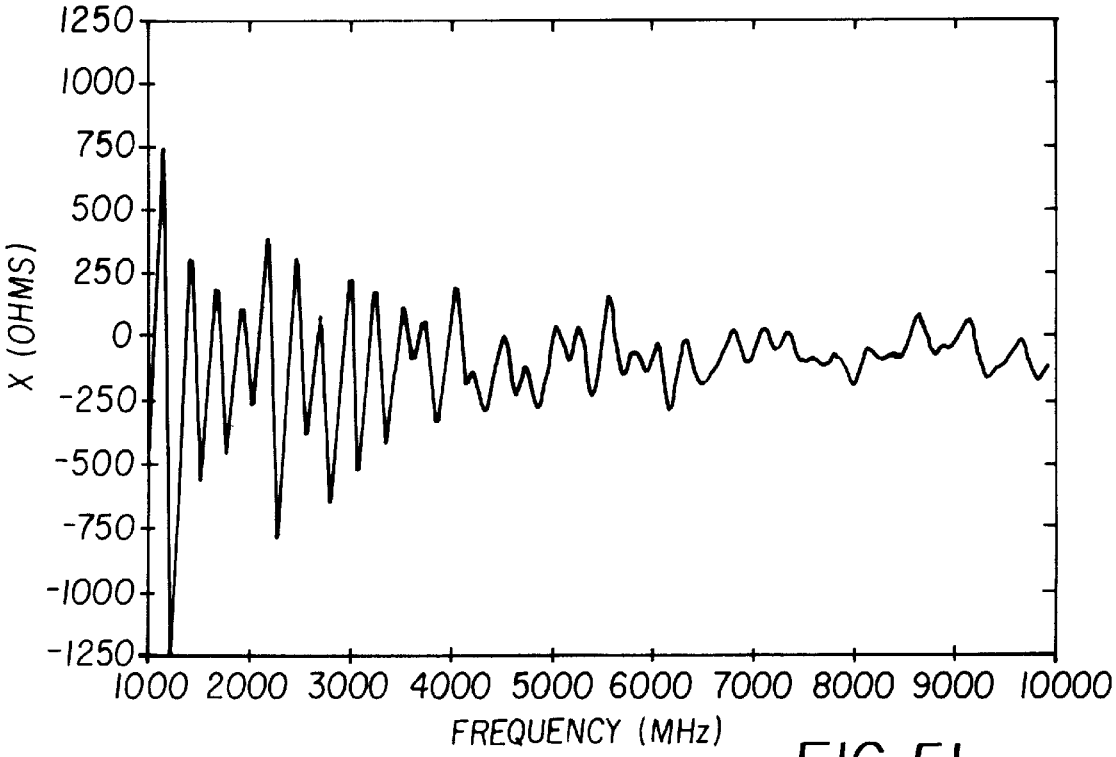
Figure 6A:
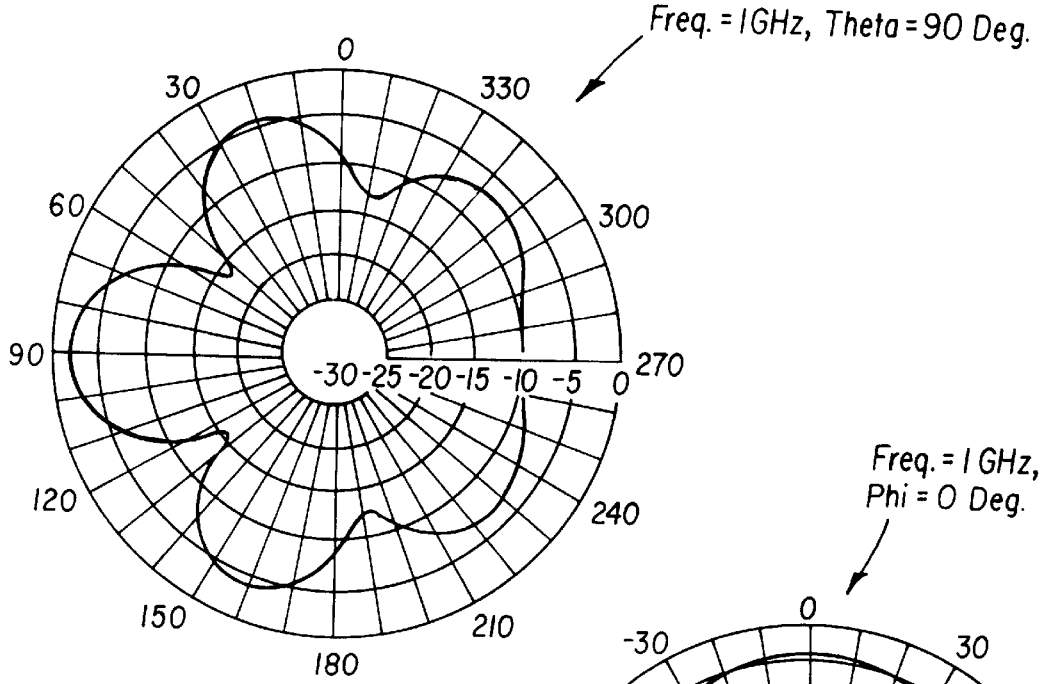
FIGS. 6(*a*), (*b*) and (*c*) illustrate the radiation patterns for the antenna illustrated in FIG. 4 at a frequency of 1 GHz.
Figure 6B:
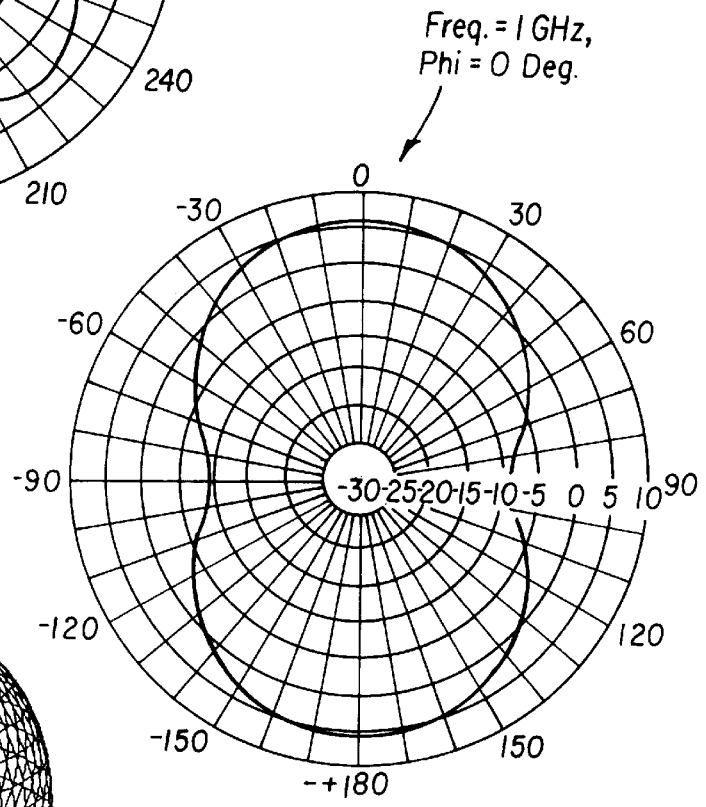
Figure 6C:
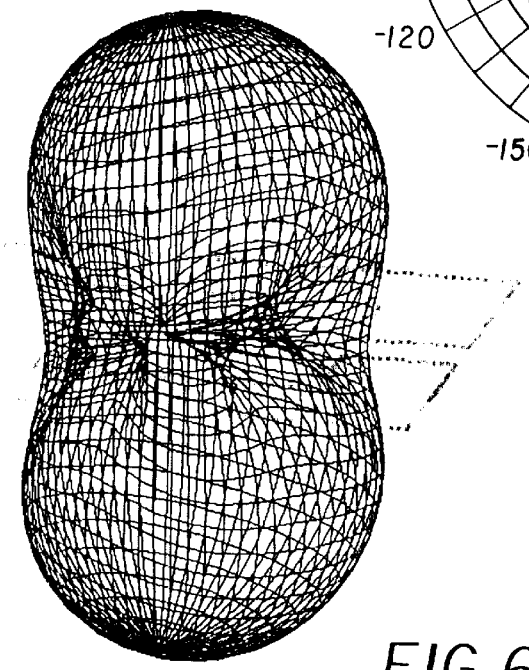
Figure 7A:
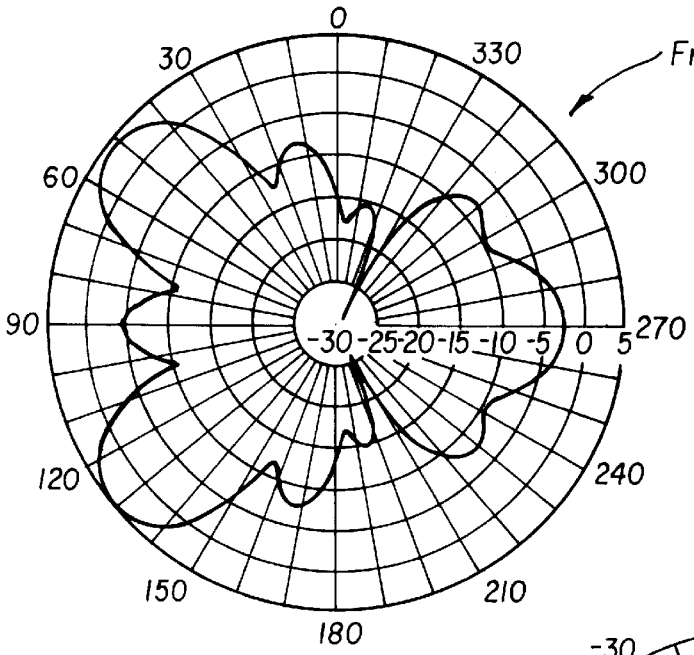
FIGS. 7(*a*), (*b*) and (*c*) illustrate the radiation patterns for the antenna illustrated in FIG. 4 at a frequency of 2 GHz.
Figure 7B:
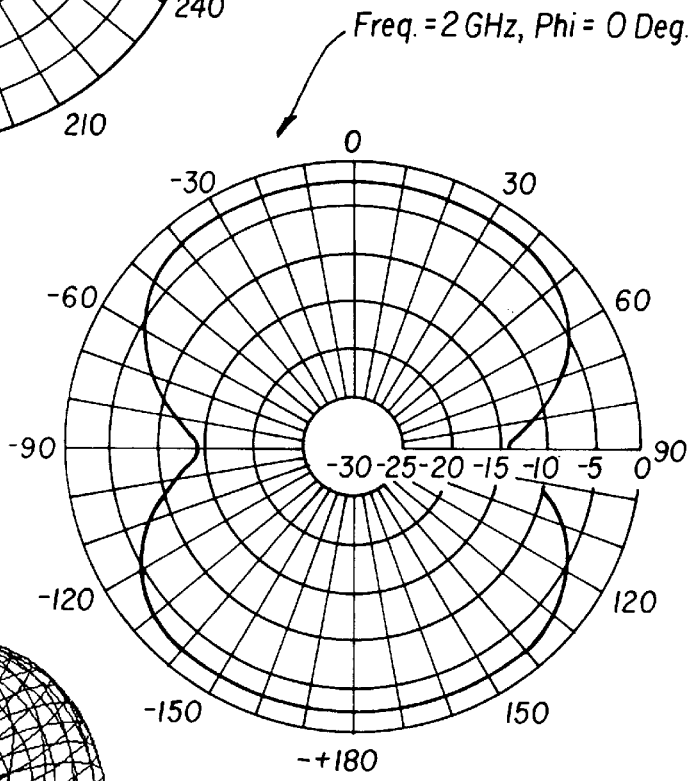
Figure 7C:
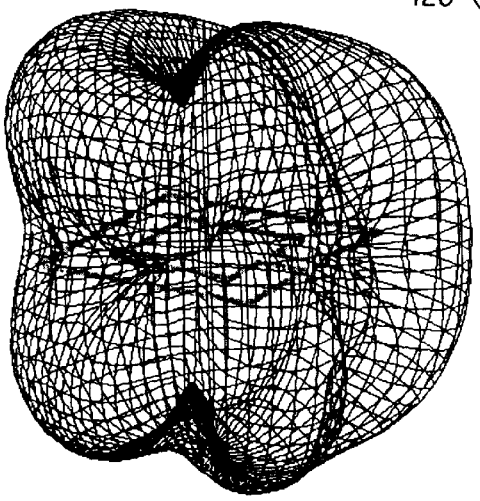
Figure 8A:
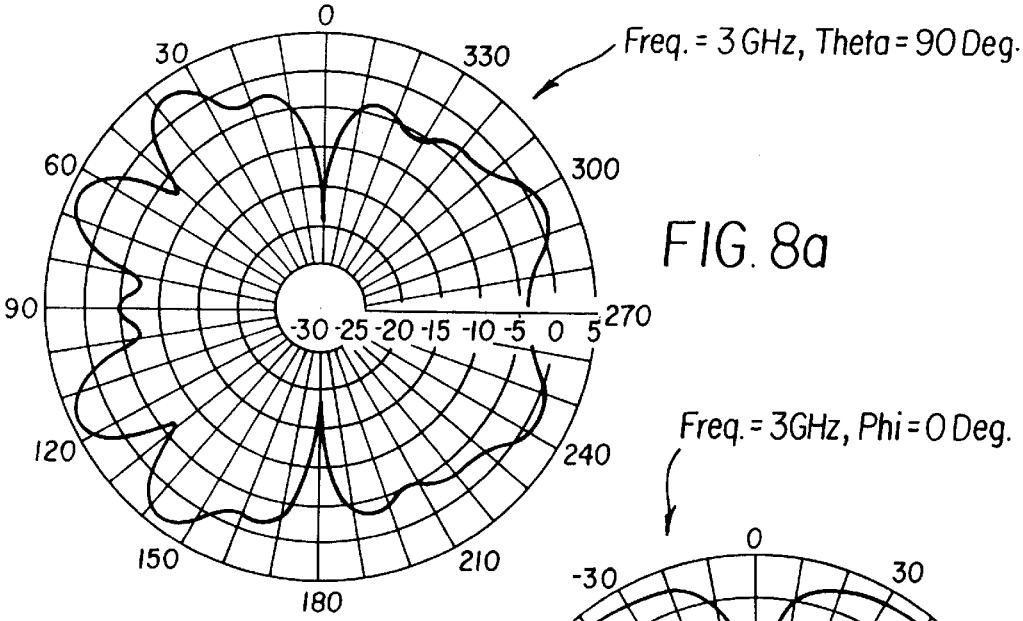
FIGS. 8(*a*), (*b*) and (*c*) illustrate the radiation patterns for the antenna illustrated in FIG. 4 at a frequency of 3 GHz.
Figure 8B:
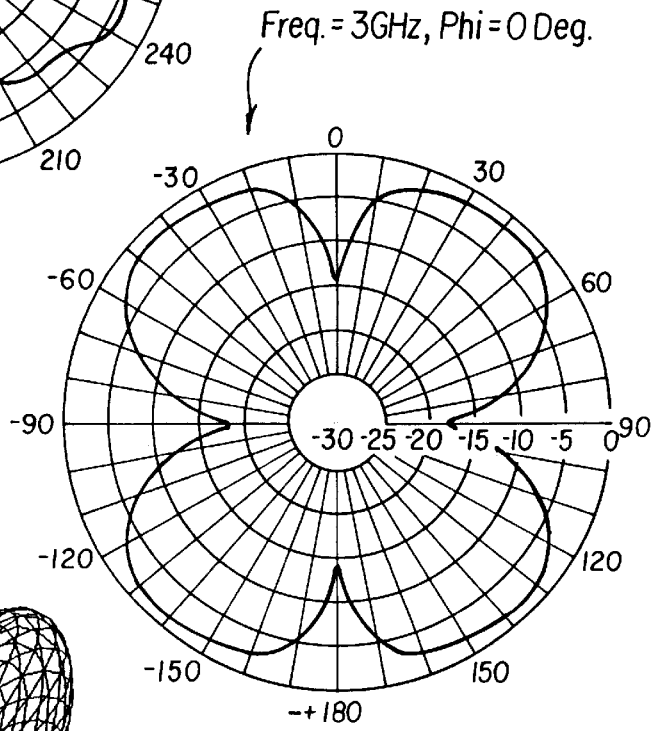
Figure 8C:
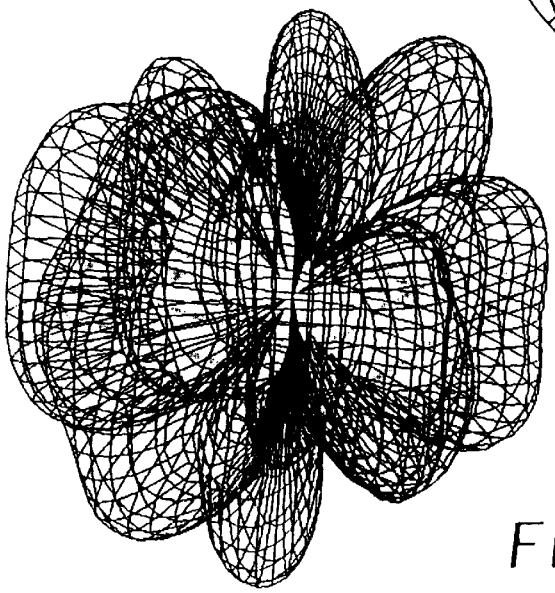

FIG. 4 illustrates a simple two fractal element antenna 38 including a first substantially square fractal element 40 having sides L3, L4 that are ten centimeters in length. A gap L5 of a length of two centimeters is provided on one side of the fractal element 40, and connection paths 42 connect the first fractal element 38 to a second substantially square fractal element 44 having sides L1, L2 that are eighteen centimeters in length. The input impedance of the antenna 38 over a desired frequency bandwidth is illustrated in FIGS. 5(*a*) and 5(*b*). The radiation pattern for the antenna 38 at a frequency of 1 GHz is shown in FIGS. 6(*a*), (*b*) and (*c*), at a frequency of 2 GHz is shown in FIGS. 7(*a*),(*b*) and (*c*), and at a frequency of 3 GHz is shown in FIGS. 8(*a*), (*b*) and (*c*).

It will be understood that a variety of manufacturing techniques can be employed to manufacture the illustrated antenna structures. For example, the fractal elements can be formed of a patterned metal layer placed on a substrate, wherein the patterned metal layer can be cut from a solid sheet or deposited by various deposition techniques. Deposition techniques are commonly employed to form micropatch antenna structures. Alternatively, the fractal elements can be formed of wire or other self supporting conductive materials.

Figure 9:
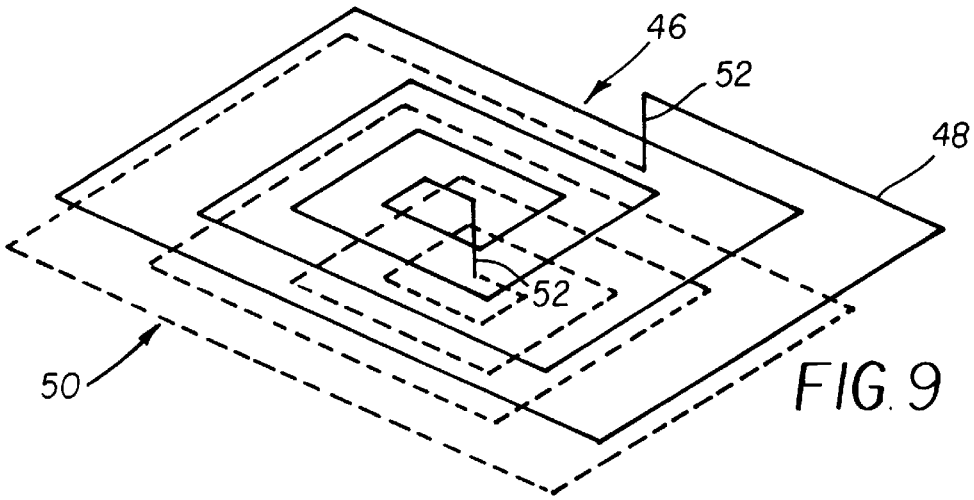
FIG. 9 illustrates a series connected multiple fractal loop antenna in accordance with the invention.
Figure 10A:
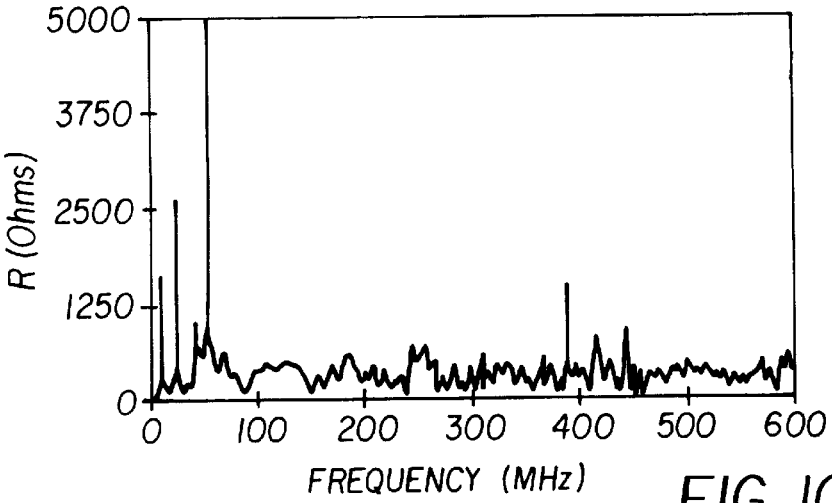
FIGS. 10(*a*) and (*b*) illustrate the input impedance of the antenna illustrated in FIG. 9 over a desired frequency band.
Figure 10B:
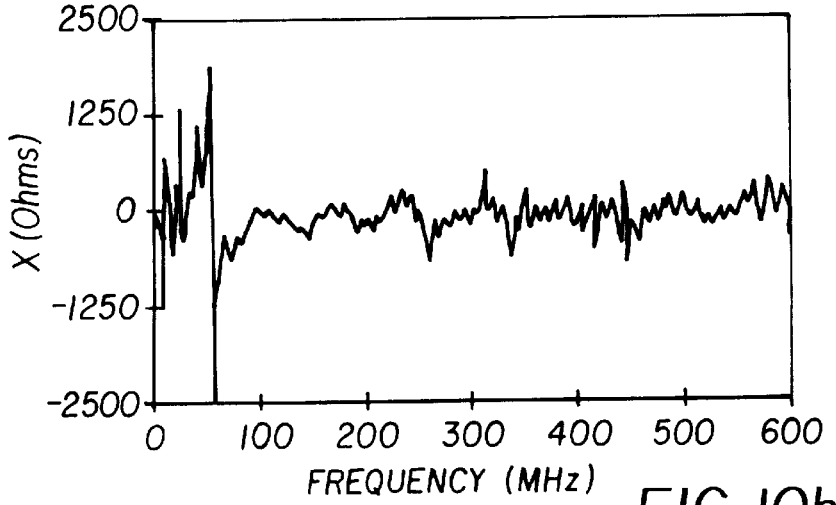
Figure 11A:
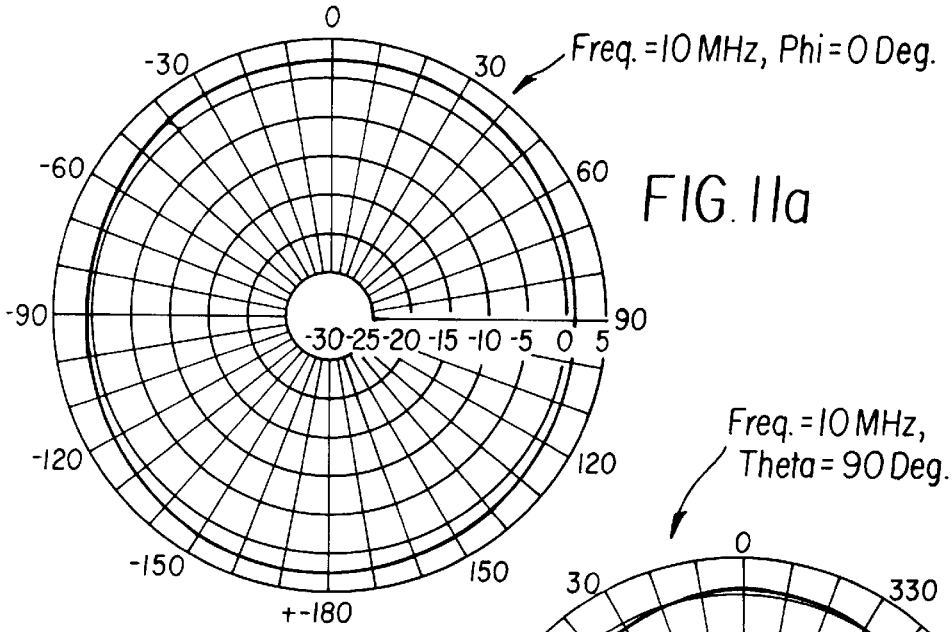
FIGS. 11(*a*), (*b*) and (*c*) illustrate the radiation pattern of the antenna illustrated in FIG. 9 at a frequency of 10 MHz.
Figure 11B:
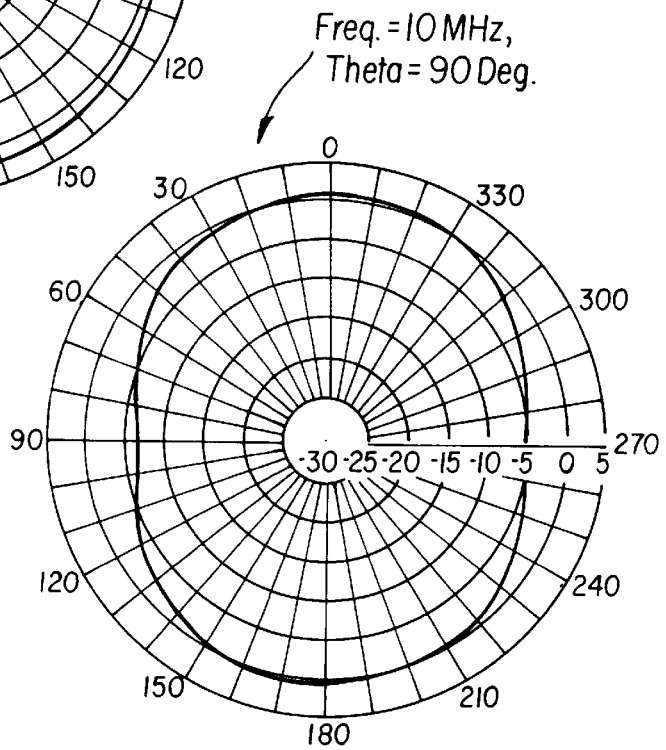
Figure 11C:
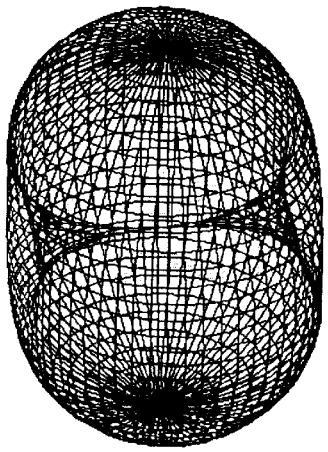
Figure 12A:
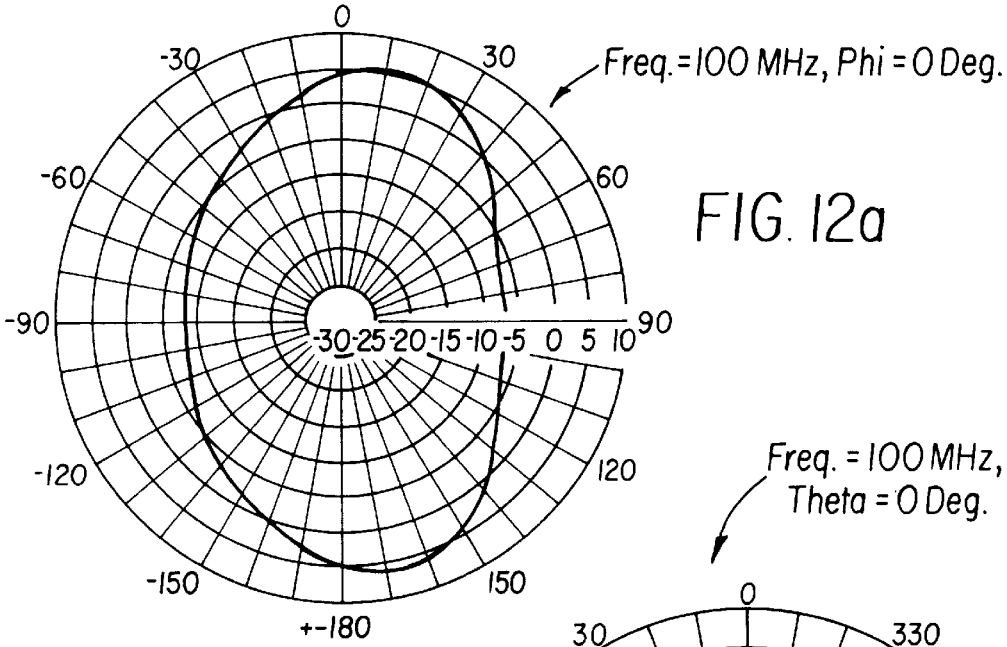
FIGS. 12(*a*), (*b*) and (*c*) illustrate the radiation pattern of the antenna illustrated in FIG. 9 at a frequency of 100 MHz.
Figure 12B:
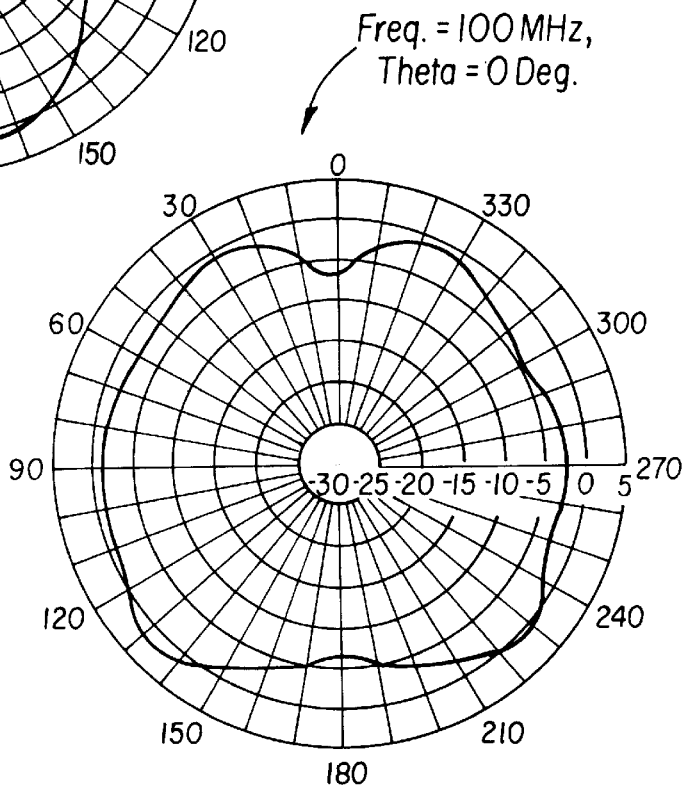
Figure 12C:
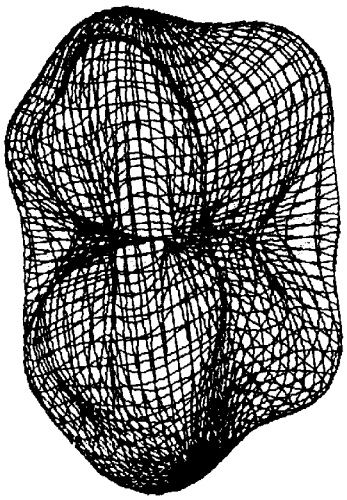

Referring now to FIG. 9, a series connecting multiple fractal loop antenna 46 is shown including a first spiral type fractal element 48, including a plurality of rectangular loops, located in a first plane that is coupled to a second spiral type fractal element 50 (indicated by dashed lines), including a plurality of rectangular loops, located in a second plane by connection paths 52. The input impedance of the antenna 46 over a desired frequency band is illustrated in FIGS. 10(*a*) and (*b*). The radiation pattern of the antenna 46 at a frequency of 10 MHz is shown in FIGS. 11(*a*), (*b*) and (*c*), and at a frequency of 100 MHz is shown in FIGS. 12(*a*), (*b*) and (*c*).

Figure 13:
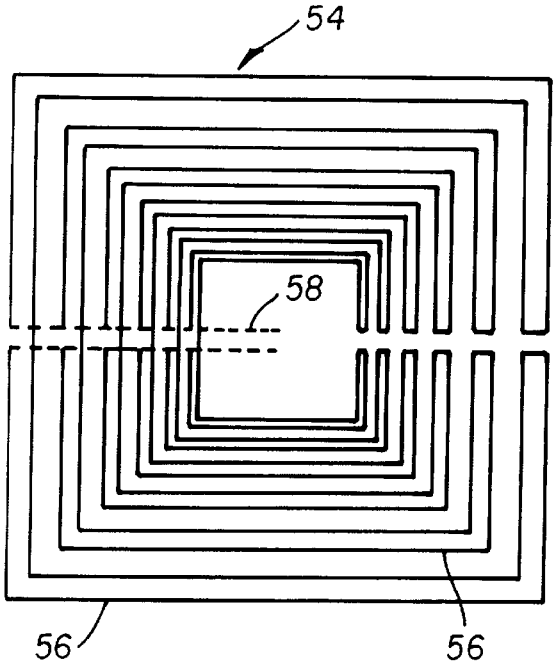
FIG. 13 illustrates a parallel connected multiple fractal loop antenna in accordance with the invention.
Figure 14:
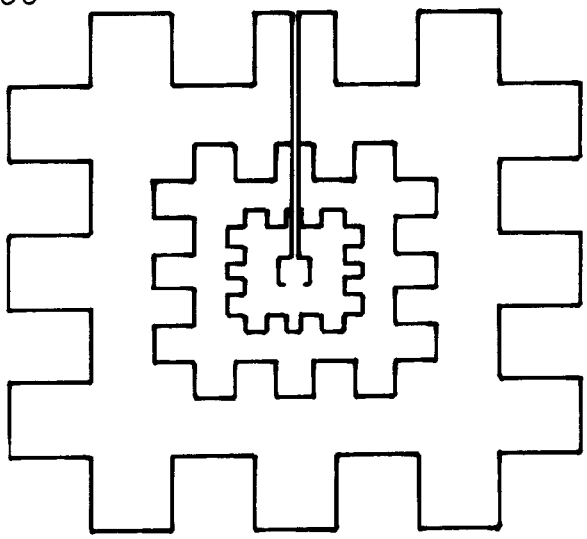
FIG. 14 illustrates a parallel connected multiple fractal loop antenna with folded sides in accordance with the invention.

Referring now to FIG. 13, a parallel connected multiple fractal loop antenna 54 is shown having a number of fractal elements 56 that are parallel connected by connection paths 58. As with the prior embodiments discussed above, the loops of the fractal elements 56 can be folded in the same plane, as shown in FIG. 14, or folded to form a three dimensional structure.

Figure 15:
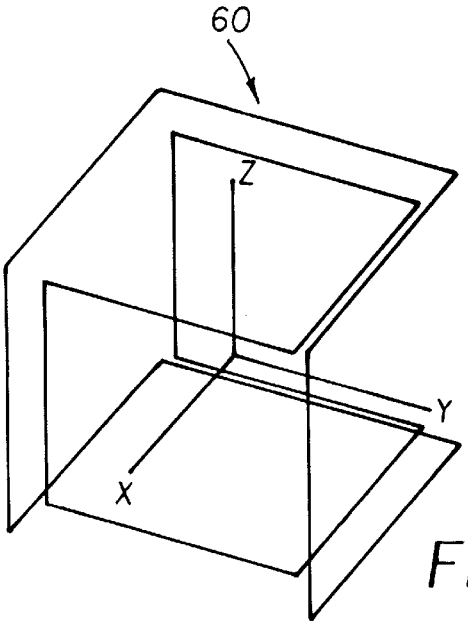
FIG. 15 illustrates a cube shaped three dimensional fractal antenna in accordance with the invention.
Figure 16:
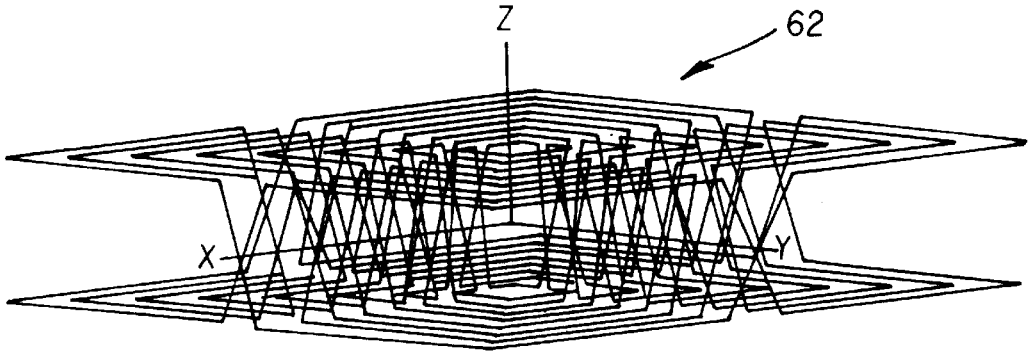
FIG. 16 illustrates a three dimensional fractal antenna in accordance with the invention.
Figure 17:
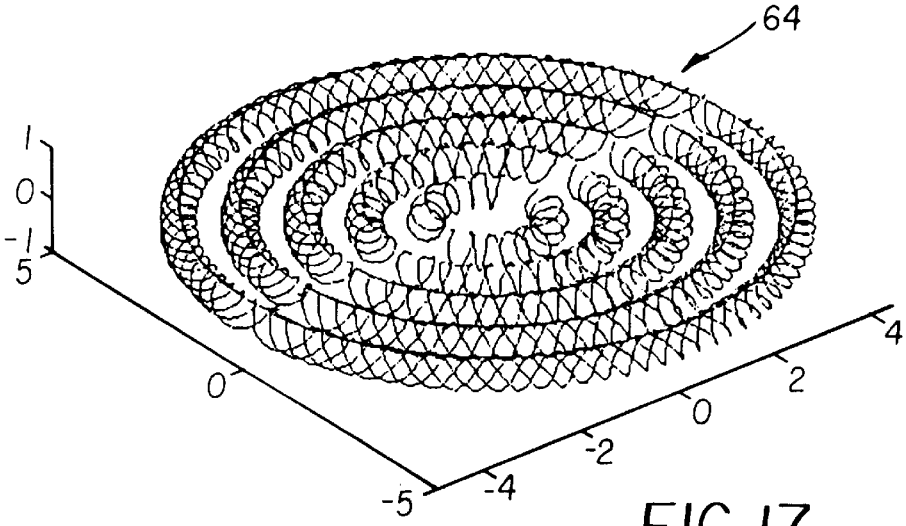
FIG. 17 illustrates a three dimensional fractal antenna that utilizes spiral loops in accordance with the invention.
Figure 18:
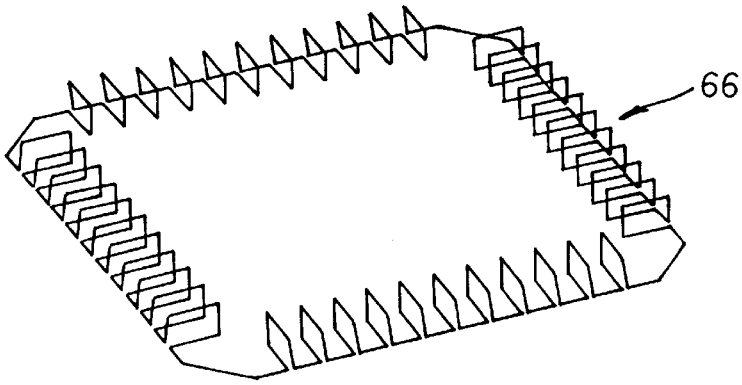
FIG. 18 illustrates a three-dimensional folded wire loop antenna in accordance with the invention.

Still further embodiments are possible. FIGS. 15, 16, 17 and 18 illustrates various examples of three dimensional fractal antennas. In FIG. 15, a fractal antenna structure 60 is formed in an overall cube shape. In FIG. 16, a fractal antenna 62 has a generally square shape when viewed from above. In FIG. 17, a fractal antenna 64 is composed of a plurality of fractal elements in the form of spirals or helical wires. In FIG. 18, a fractal antenna 66 incorporating a folded wire loop is illustrated. In practice, multiple folded wire loops would be employed, but are not shown for the sake of simplicity.

The invention has been described with reference to certain preferred embodiments thereof. It will be understood, however, that modification and variations are possible within the scope of the appended claims. For example, the fractal antenna and its loops may be formed in any desired geometric shape or configuration.

What is claimed is:

1. A fractal antenna comprising:

a plurality of fractal elements, wherein each of the fractal elements is of a different dimensional size and wherein the sides of each of the fractal elements are folded in a same plane of the fractal element to form a sawtooth pattern; and connection means for connecting the fractal elements in one of a cascade connection, a series connection and a parallel connection.

2. A fractal antenna as claimed in claim 1, wherein each fractal element is also folded in a plane perpendicular to the same plane as the fractal element.

3. A fractal antenna comprising:

a plurality of fractal elements, wherein each fractal element is a three dimensional element of a different dimensional size; and connection means for connecting the fractal elements in one of a cascade connection, a series connection and a parallel connection.

4. A fractal antenna as claimed in claim 3, wherein each fractal element comprises a sprial or helical geometric shape.

5. A fractal antenna as claimed in claim 3, wherein each fractal element comprises a folded wire loop, wherein each loop includes a plurality of loop elements oriented in a plane perpendicular to a main plane of the folded wire loop.

6. A fractal antenna as claimed in claim 3, wherein each fractal element comprises a generally square geometric shape, wherein first and second corners of each fractal element are in a first plane and third and fourth corners of each fractal element are in a second plane that is parallel to the first plane.

7. A fractal element as claimed in claim 6, wherein the first and second corners are opposite to one another and the third and fourth corners are opposite to one another.

* * * * *